US005711136A

United States Patent [19]

Carcano

[11] Patent Number: 5,711,136

[45] Date of Patent: Jan. 27, 1998

[54] DEVICE AND METHOD FOR CREATING A VACUUM IN BAGS

[75] Inventor: Maurizio Carcano, Pavia, Italy

[73] Assignee: Goglio Luigi Milano SpA, Milano, Italy

[21] Appl. No.: 676,054

[22] Filed: Jul. 5, 1996

[30] Foreign Application Priority Data

Sep. 5, 1995 [IT] Italy ..... MI95A1863

[51] Int. Cl.[6] ..... B65B 31/06

[52] U.S. Cl. ..... 53/434; 53/512

[58] Field of Search ..... 426/404, 410, 426/413; 53/510, 511, 432, 433, 405, 434, 512

[56] References Cited

U.S. PATENT DOCUMENTS

| | | | |
|---|---|---|---|
| 3,175,590 | 3/1965 | Belknap | 53/512 X |
| 3,182,432 | 5/1965 | Canfield | 53/512 |
| 3,254,467 | 6/1966 | Garrow et al. | 53/512 X |
| 3,304,687 | 2/1967 | Tomczak et al. | 53/434 X |
| 3,312,256 | 4/1967 | Reisinger | 53/512 X |
| 3,511,020 | 5/1970 | Kraft et al. | 53/512 |
| 3,518,809 | 7/1970 | Ott | 53/511 |
| 3,630,665 | 12/1971 | Andersen et al. | 53/434 X |
| 3,648,740 | 3/1972 | Pruitt | 53/512 X |
| 3,700,387 | 10/1972 | Moore et al. . | |
| 3,939,287 | 2/1976 | Orwig et al. | 53/512 X |
| 4,035,982 | 7/1977 | Paules | 53/434 X |
| 4,148,933 | 4/1979 | Janovtchik | 53/432 X |
| 4,418,512 | 12/1983 | Johnson | 53/512 X |
| 4,736,572 | 4/1988 | Fang et al. . | |
| 5,044,142 | 9/1991 | Gianelli | 53/434 |
| 5,109,654 | 5/1992 | Suga | 53/511 |
| 5,263,520 | 11/1993 | Arai | 53/512 X |
| 5,473,866 | 12/1995 | Maglecic et al. | 53/511 |
| 5,491,957 | 2/1996 | Maskell | 53/432 X |
| 5,551,213 | 9/1996 | Koelsch et al. | 53/432 X |

FOREIGN PATENT DOCUMENTS

| | | |
|---|---|---|
| 0 734 951 | 10/1996 | European Pat. Off. . |
| 782239 | 4/1955 | United Kingdom . |

*Primary Examiner*—Daniel Moon

*Attorney, Agent, or Firm*—Burns, Doane, Swecker & Mathis, L.L.P.

[57] ABSTRACT

A device and method are described for creating a vacuum in bags (20), particularly those for holding food products, in which the device comprises an outer tube (10) that is inserted into the bag (20) from above and an inner tube (11) that can slide axially inside the tube (10) to move from a retracted position in which it is completely housed inside the tube (10) to an extended position in which it protrudes downwards from the robe. The inner tube (11) takes up a position protruding from the tube (10) during creation of the vacuum in the bag (20) and a retracted position inside the tube (10) to allow sealing of the bag (20) by means of a pair of sealing bars (32).

5 Claims, 5 Drawing Sheets

DEVICE AND METHOD FOR CREATING A VACUUM IN BAGS

FIELD OF THE INVENTION

The present invention relates to a device and a method for creating a vacuum in bags, particularly in packs with one or more layers of sheet material, for holding granular or pulverulent products or the like.

BACKGROUND AND SUMMARY OF THE INVENTION

As is known, various methods exist for creating vacuum in a pack.

One method entails having the head of the vacuum-creating machine work in a bell inside which the pack is placed. When all the air is sucked from the bell, the residual air in the pack is obviously drawn off too, after which the pack is sealed.

Another method, which is that to which the present invention refers, entails inserting a suction tube, known as a "snorkel", into the bag, open at the top; the air contained in the bag is drawn through the tube, to create the vacuum. When the vacuum has been created in the bag, the tube (snorkel) remains trapped inside it and can be removed only after the opposite walls of the bag have been soldered beneath the bottom end of said tube.

This method, though widely used, presents great drawbacks.

Since the products contained in the packs in which the vacuum must be created are generally food products, it is clearly deskable to produce the highest vacuum possible to allow better preservation of the product. The further the tube is inserted inside the bag, that is the nearer its end is to the product, the higher the vacuum that can be reached. However, the suction tube cannot be inserted far into the bag, to leave sufficient space to seal it.

The degree of vacuum that can be produced can also be improved by using a large-sized tube. However, in this case when soldering is carried out to seal the bag, creases can form that jeopardise the vacuum seal.

The aim of the invention is to eliminate the drawbacks of this vacuum creating and sealing method, providing a device and relative method that allow a high vacuum to be reached in the packs, ensuring perfect seals, without any creases forming.

This aim is achieved, according to the invention, by a method and apparatus as described below.

Preferred embodiments of the invention appear from the dependent claims.

According to the invention, the suction tube substantially contains inside it a second tube axially mobile with respect to said suction tube, so as to protrude from it and penetrate further into the pack during the suction stage, returning into the outer tube at the end of the suction stage to allow sealing of the pack.

The inner tube thus performs the dual function of holding the opposite wails of the pack apart during the suction stage, preventing them from obstructing the mouth of the suction tube, and at the same time improving the vacuum that can be reached by also sucking through the inner tube.

BRIEF DESCRIPTION OF THE DRAWINGS

Further characteristics of the invention will be made clearer by the detailed description that follows, referring to a purely exemplary and therefore non-limiting embodiment, illustrated in the attached drawings in which.

DETAILED DESCRIPTION

Figure 1:
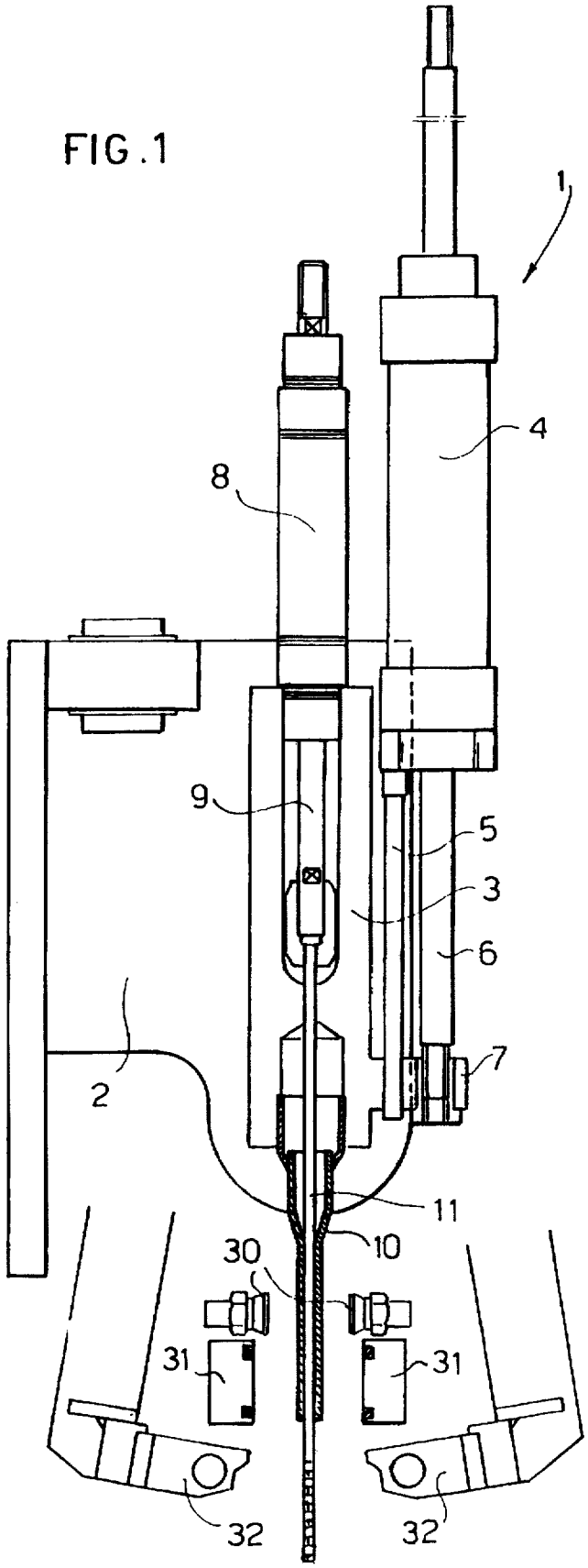
FIG. 1 is a schematic side elevation view, with some parts in sectional view, of the head of the device for creating a vacuum in bags according to the invention.

With reference to these figures, 1 indicates the device according to the invention as a whole, comprising a fixed structure 2, inside which a slide 3 driven by a cylinder 4 slides vertically, guided on a column 5. The cylinder 4 is integral with the structure 2 and acts, by means of its stem 6, on a projecting side part 7 of the slide 3.

The upper end of a suction tube 10 (seen better in FIGS. 8 and 9), whose structure will be better described below, is fixed on the bottom of the slide (3), a second tube 11 being disposed inside said tube 10 and axially mobile with respect to it.

The inner tube 11 is operated independently by the stem 9 of a second cylinder 8 integral with the slide 3.

In this way, actuation of the cylinder 4 produces simultaneous movement of the tubes 10, 11, whilst actuation of the cylinder 8 produces a relative movement of the inner tube 11 with respect to the outer tube 10, for the purposes that will be stated below.

Figure 7:
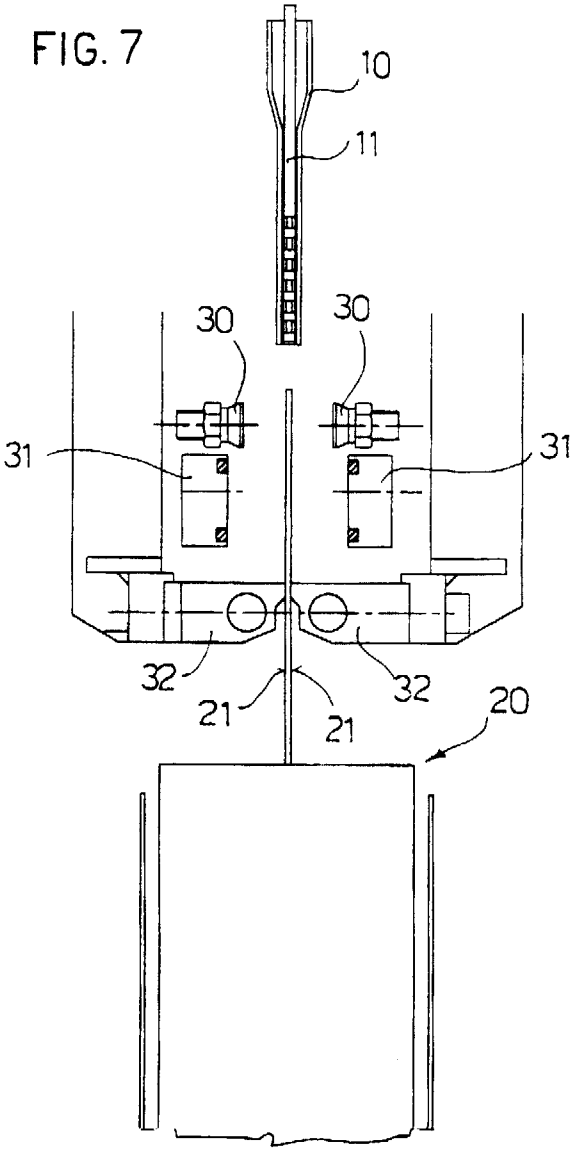
Figure 8:
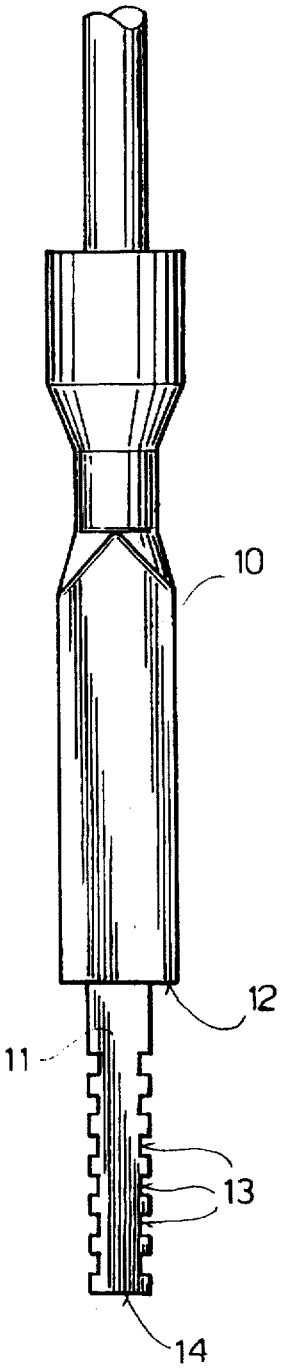
FIG. 8 is a view of a suction tube, taken at 90° with respect to the preceding figures.
Figure 9:
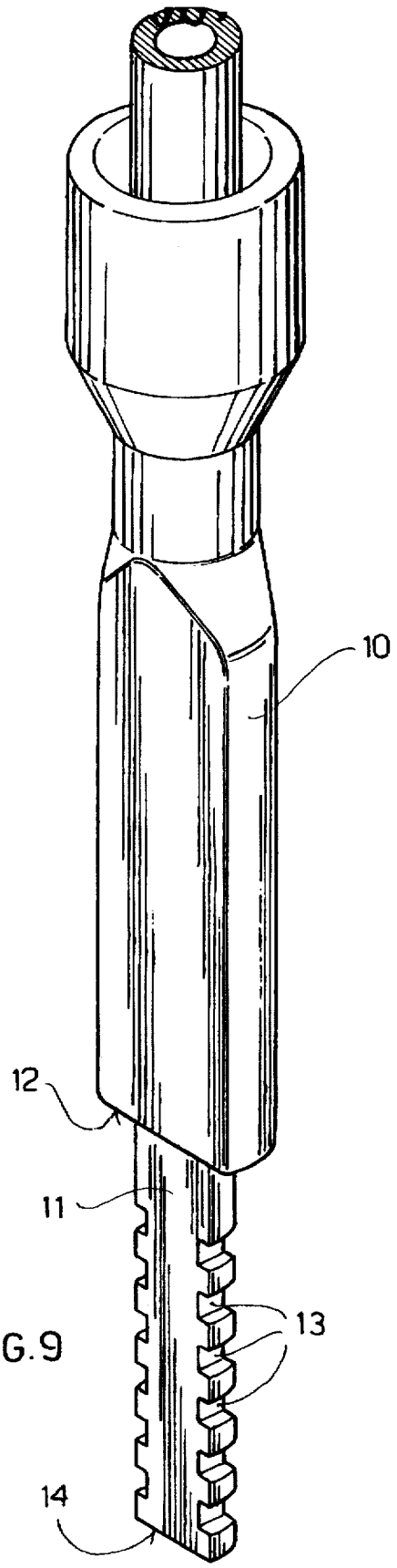
FIG. 9 is an axonometric view of the tube in FIG. 8.

As can be seen from FIGS. 8 and 9, both tubes 10, 11 have a highly flattened shape, so as to allow opposite side walls 21 of a bag or a pack 20 in which vacuum must be created to be kept at a minimal distance (FIGS. 2–7).

The tube 10 has a bottom opening 12, whilst the inner tube 11 has a plurality of side openings 13 on its narrow sides.

Should the bag 20 contain non-pulverulent products, openings can also be provided on a bottom wall 14 of the inner tube 11, which in the example shown, however, is closed.

Returning to FIG. 1, it will be noted that the device according to the invention comprises, on both sides of the suction tube 10, 11 and beneath it, when it is in the raised position, a pair of suction cups 30, such as to separate the upper edges 21' of the opposite side walls 21 of the bag 20 that is positioned under the device for vacuum creation and sealing. The suction cups 30 can obviously be replaced by similar means, such as a pair of pincers, for example. Two shaped bars 31 are situated under the suction cups 30 and close on the opposite wails 21 of the bag 20, creating a tight closure around the tube 10, when the tube is inserted in the bag.

Beneath the shaped bars 31, two sealing bars 32 are provided to seal the bag after creation of the vacuum.

Having briefly described the basic elements of the device according to the invention, operation thereof will now be described, with particular reference to FIGS. 2 to 7.

The pack 20 for vacuum sealing is fed and positioned, in a per se known fashion, under the device 2, resting on a flat base 40 and possibly disposed between a pair of side walls 41 that help maintain it in an upright position.

Figure 2:
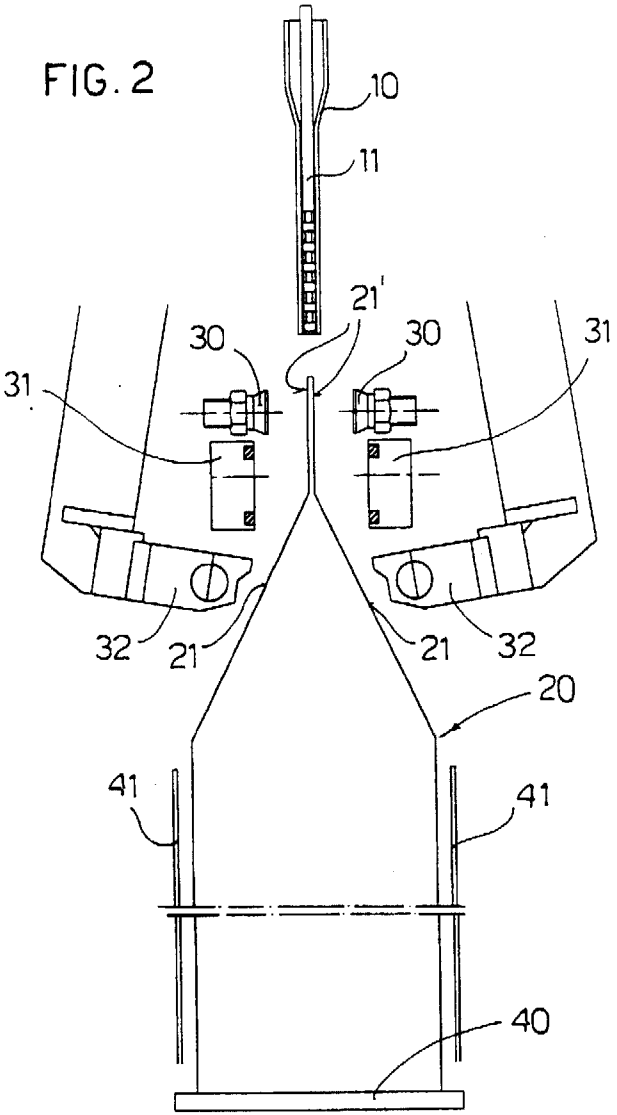

In this position, shown in FIG. 2, the inner tube 11 is retracted inside the tube 10 and both tubes 10, 11 are in the raised position, above a top margin of the bag 20, whose upper edges 21' of the opposite side walls 21 are held together, for example by means of soldered points or bonding spots, an expedient generally used to facilitate transfer of the bag from the filling station to the sealing station.

As can be seen again in FIG. 2, the pairs of suction caps 30, shaped bars 31 and sealing or soldering bars 32 are in the open position.

Figure 3:
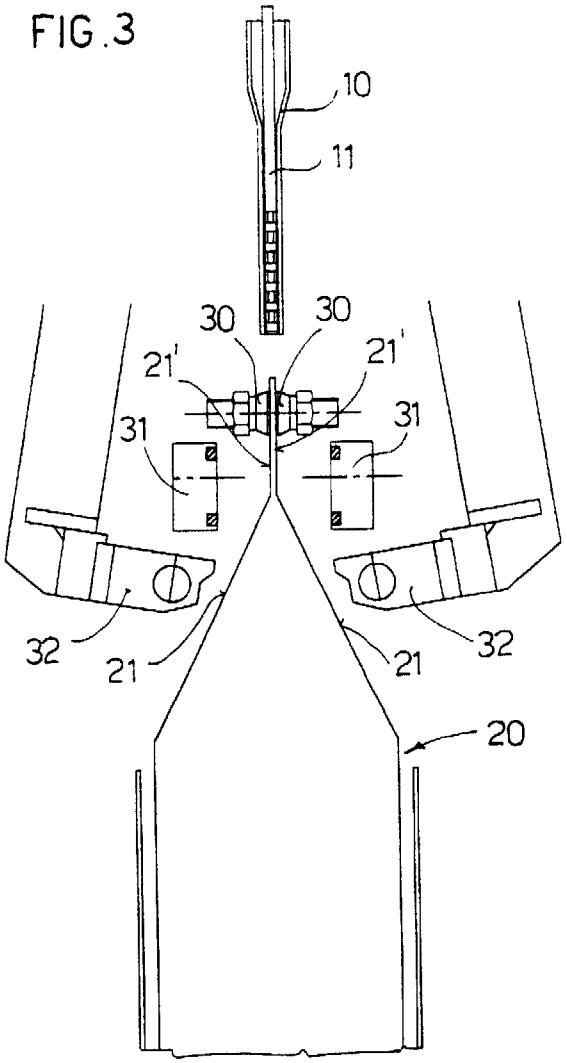
FIGS. 2 to 7 are even more schematic views similar to that in FIG. 1, showing the successive stages of a cycle for creating a vacuum inside a bag.

As can be seen in FIG. 3, the suction cups 30 close on the upper edges 21' of the opposite side walls 21 of the bag 20 and subsequently reopen (FIG. 4) to bring said edges apart, producing an upper opening 50 for insertion of the tube 10.

Figure 5:
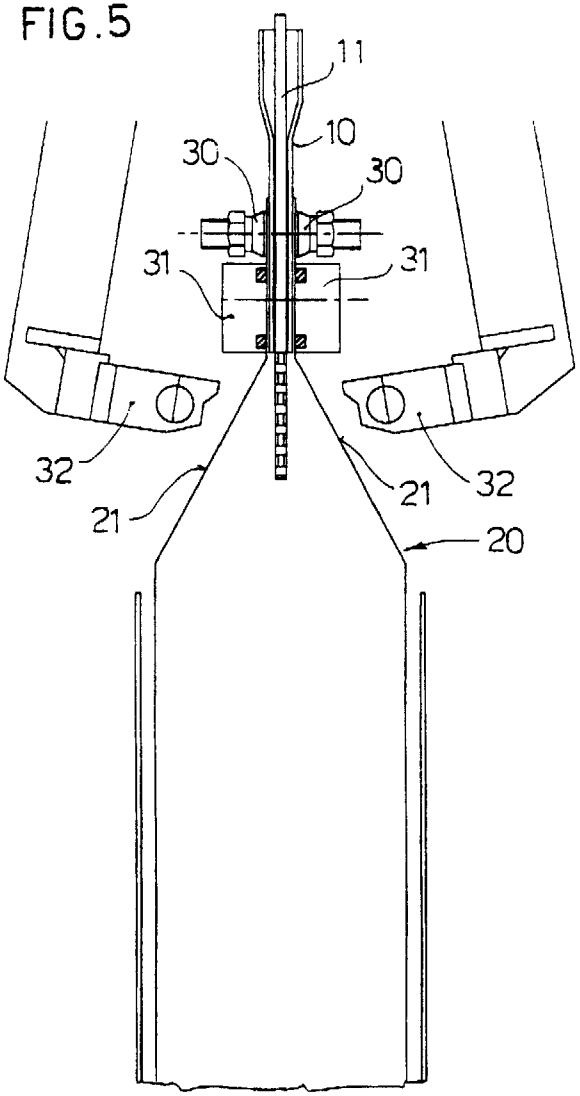
Figure 4:
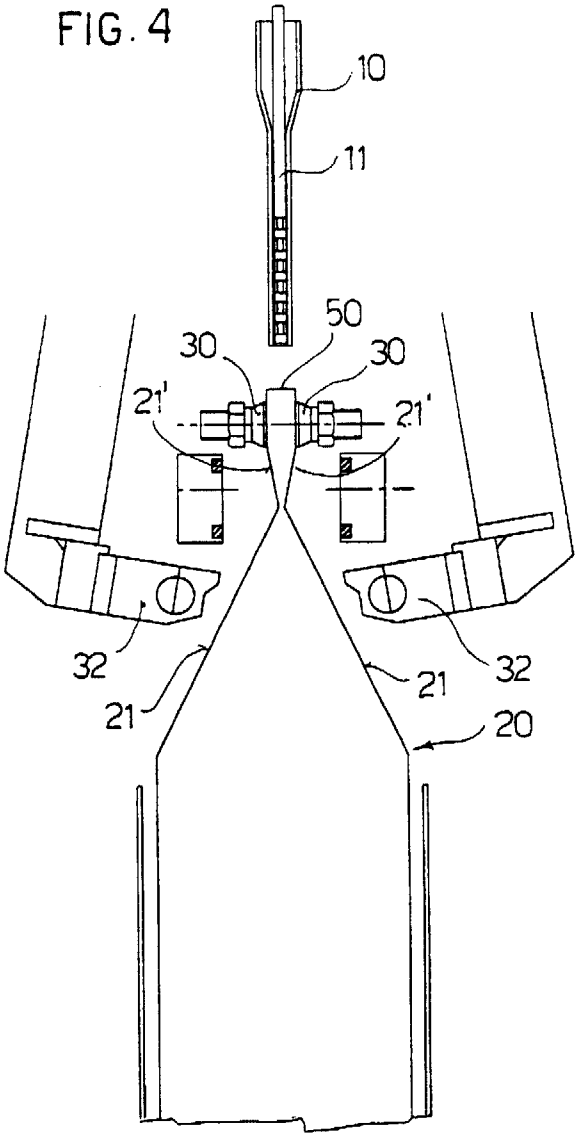

At this point first the cylinder 4 is operated to cause simultaneous lowering of the tubes 10, 11, and then the cylinder 8 is operated to produce a further lowering of the inner tube 11 alone and thus cause it to come out of the tube 10, as shown in FIG. 5, where the shaped bars 3 1 are already tightly closed on the tube 10.

Figure 6:
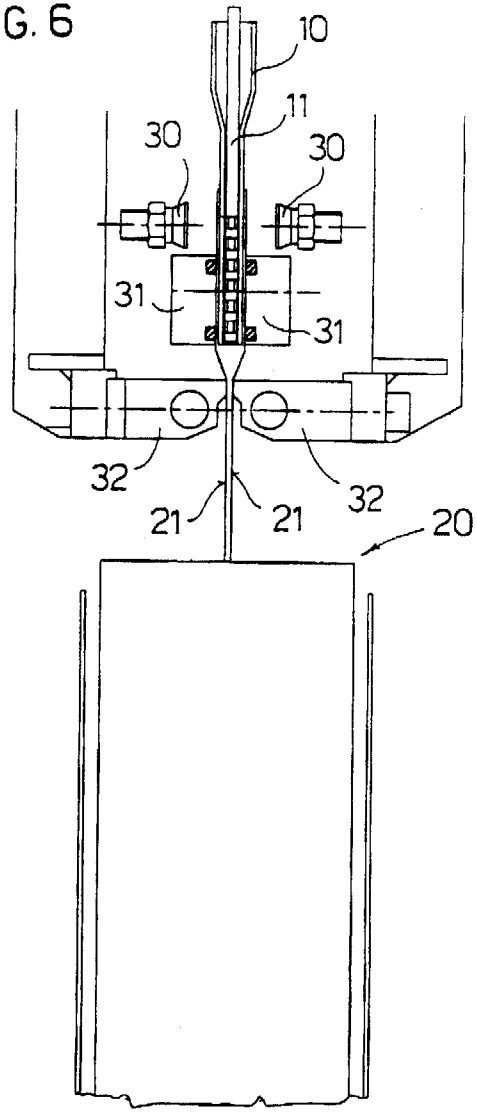

Once the stage of creating a vacuum in the bag 20 has been completed, the opposite walls 21 are drawn together as shown in FIG. 6. At this point the inner tube 11 is retracted inside the tube 10 by again operating the cylinder 8 in the opposite direction, thus allowing closing of the sealing bars 32 that carry out sealing of the bag 20.

The suction cups 30 and the shaped bars 31 are then opened, after which the tubes 10 and 11 are removed from the bag with a simultaneous movement, by operating the cylinder 4 (FIG. 7).

The sealing bars 32 are then opened and the pack is ready to be placed on the market, once the sealed edges have been folded, in a per se known manner.

The tubes 10 and 11 are advantageously made of metal, but they can also be made of plastic or other suitable materials.

From what is described, the advantages of the invention are obvious in that, thanks to provision of the inner tube 11 it allows the opposite side walls 21 of the bag 20 to be held apart during the final stage of creation of a vacuum inside the bag, and at the same time it allows a higher vacuum to be produced thanks to the suction applied through said inner tube 11, which is positioned much closer to the product than the outer tube 10.

What is claimed is:

1. A device for creating a vacuum in bags, comprising:

a movable first suction tube having a bottom end insertable from above into a bag having an open top, the first suction tube having a highly flattened shape with wider front and back walls and narrower side walls, means for inserting the bottom end of the first suction tube into a bag, a pair of shaped bars to close the bag tightly around said first outer tube during suction of air contained in the bag, the shaped bars disposed parallel to the wider walls of the first suction tube, means for sealing the bag disposed at a lower level with respect to the inserted position of the bottom end of said tube and said pair of shaped bars, and a second tube, disposed axially inside said first tube, and moveable between a retracted position housed completely inside the first tube and an extended position protruding downward from said first tube, the second tube having a highly flattened shape with wider front and back walls and narrower side walls, the second tube having a perforated bottom wall and a plurality of perforations in the narrower side walls.

2. A device according to claim 1, wherein said means for sealing the bag includes a pair of heat sealing bars, the heat sealing bars disposed parallel to the wider front and back walls of the first tube.

3. A device according to claim 1, further comprising means for holding apart upper edges of the bag for inserting the first tube.

4. A method of creating a vacuum in a bag, comprising the steps of:

placing a bag having an open top under a first suction tube, extending said first suction tube into the bag through the open top, clamping the top of the bag around the first suction tube to form a temporary seal, extending a second tube axially from an end of the first tube further into the bag, activating suction means to remove air from the bag through the first and second tubes to create a vacuum in the bag, retracting the second tube into the first tube after a vacuum has been created in the bag, sealing said bag at a location beneath a maximum entry position of said first tube and below the clamped portion of the bag, and, after sealing the bag, releasing the clamped portion of the bag.

5. A device for creating a vacuum in bags, comprising:

a first suction tube having a flattened shape with a wide front and back and narrow sides and having a bottom end;

means for inserting the bottom end of the first tube into a bag having an open top;

bar clamping means for releasably sealing a top portion of a bag around the bottom end of the first tube, the clamping means acting from front and back of the first suction tube;

a second tube, disposed axially inside said first tube, and moveable between a retracted position housed completely inside the first tube and an extended position protruding downward from said first tube, the second tube having a flattened shape with wider front a hack walls and narrower side walls, the second tube having a plurality of openings on the narrower side walls, suction means for drawing air through the first and second tubes, and means for sealing the bag at a position lower than the clamping means and the inserted position of the bottom end of said first tube.

* * * * *